US005484080A

United States Patent [19]

Blasnik et al.

[11] Patent Number: 5,484,080

[45] Date of Patent: Jan. 16, 1996

[54] LIQUID CONTAINER WITHIN RETRACTABLE STRAW

[76] Inventors: William Blasnik, 1512 Palisade Ave., Fort Lee, N.J. 07024; Robert A. Coonradt, 8851 Vamo Rd., Sarasota, Fla. 34231

[21] Appl. No.: 242,878

[22] Filed: May 16, 1994

[51] Int. Cl.[6] ..... B65D 47/04

[52] U.S. Cl. ..... 220/708; 220/709

[58] Field of Search ..... 220/705, 708, 220/707, 709, 254, 425, 420; 215/1 A

[56] References Cited

U.S. PATENT DOCUMENTS

| | | | |
|---|---|---|---|
| 3,558,033 | 1/1971 | Leeds . | |
| 3,847,311 | 11/1974 | Flores et al. | 220/254 |
| 4,109,817 | 8/1978 | Payne et al. . | |
| 4,165,013 | 8/1979 | Lutz . | |
| 4,291,814 | 9/1981 | Conn . | |
| 4,448,316 | 5/1984 | Hiroshige | 215/1 A |
| 4,684,032 | 8/1987 | Tsay | 220/709 |
| 4,966,300 | 10/1990 | Coonradt . | |
| 5,150,815 | 9/1992 | Saklad | 220/708 |
| 5,199,597 | 4/1993 | Gladish | 220/254 |
| 5,203,468 | 4/1993 | Hsu | 220/708 |
| 5,273,172 | 12/1993 | Rossbach et al. | 220/708 |
| 5,339,982 | 8/1994 | Tardie | 220/709 |
| 5,346,081 | 9/1994 | Lin | 220/709 |

*Primary Examiner*—Stephen J. Castellano
*Attorney, Agent, or Firm*—Robert L. Epstein; Harold James; James & Franklin

[57] ABSTRACT

The base defines a liquid retaining reservoir and has a cover with a straw containing compartment which includes a tubular section and an enlarged section. A pivotally mounted lever has a portion accessible from the exterior of the container and an interior portion situated within the enlarged section of the straw containing compartment. In the retracted position of the straw, a lid seals the straw opening in the cover and the straw seals the liquid passage between the base reservoir and the tubular section. When pivoted, the lever moves the straw up the compartment to open the lid and protrude above the cover. The interior portion of the lever is bifurcated and moves through an arcuate path. The enlarged section is shaped to accommodate this arcuate travel path.

20 Claims, 2 Drawing Sheets

LIQUID CONTAINER WITHIN RETRACTABLE STRAW

The invention relates to drinking containers and more particularly to an insulated liquid container for drinking which includes a retractable straw.

Drinking containers with retractable straws are known. For example, U.S. Pat. No. 4,966,300 issued Oct. 30, 1990 to Robert A. Coonradt and entitled "Insulated Drinking Container" discloses a container having an insulated base and cover. The Coonradt container has a pneumatically operated retractable straw provided in a housing attached to the cover. The cover has a handle with a portion which can be squeezed to force air along a passageway to urge the top of the straw to move upwardly from a retracted position in the interior of the container to a position protruding above the surface of the cover.

The pneumatic operation requires an air sealed system capable of being pressurized. The handle must be squeezed continuously to maintain sufficient air pressure to keep the straw in the protruding position. An air sealed system is difficult and expensive to manufacture. The requirement for continuous squeezing makes the device awkward to use.

The present invention overcomes these disadvantages by substituting a simple mechanical linkage for the pneumatic system, making the container simpler and less expensive to manufacture and more reliable in operation. Moreover, the straw can be maintained in the protruding position more comfortably because it requires only the application of a light pressing force from the thumb.

It is, therefore, a prime object of the present invention to provide a liquid container with a mechanically operated retractable straw.

It is another object of the present invention to provide a liquid container with a retractable straw which can be comfortably maintained in the protruding position.

It is another object of the present invention to provide a liquid container with retractable straw which is made up of simple mechanical parts which function reliably together and can be fabricated and assembled at relatively low cost.

In accordance with the present invention, a liquid container is provided, comprising an insulated base with a liquid reservoir and an open top defined by a rim. A straw and a cover are included. The cover has means for sealingly engaging the rim and a straw containing compartment. The straw is received in the compartment for movement, a between retracted position, wherein said straw is within the base and a protruding position, wherein a portion of the straw is situated above the cover. Pivotally mounted lever means are provided. The lever means has a portion accessible from the exterior of the cover and a portion situated within the compartment for operably engaging the straw. The lever means is pivotable to move the straw between the retracted and the protruding positions.

The compartment includes a liquid passage connecting it with the reservoir. Means are provided for closing the passage when the straw is in the retracted position.

The straw engaging portion of the lever means moves through an arcuate path as the lever means is pivoted. The compartment includes an enlarged section shaped to enclose the arcuate path.

The straw engaging portion includes an elongated slot into which the straw is movably received. The straw engaging portion is bifurcated.

The cover is threadably mounted on the base to permit removal for filling and cleaning of the base. The cover includes a lid which is movably mounted to the cover adjacent the mouth of the straw containing compartment. The lid is movable between a closed position and open position. Means are provided for urging the lid towards the closed position. The urging means comprise spring loaded fingers.

To these and such other objects which may hereinafter appear, the present invention relates to a liquid container with a retractable straw, as set forth in detail in the following specification and recited in the annexed claims, taken together which the accompanying drawings, wherein like numerals relate to like parts and in which:

Figure 1:
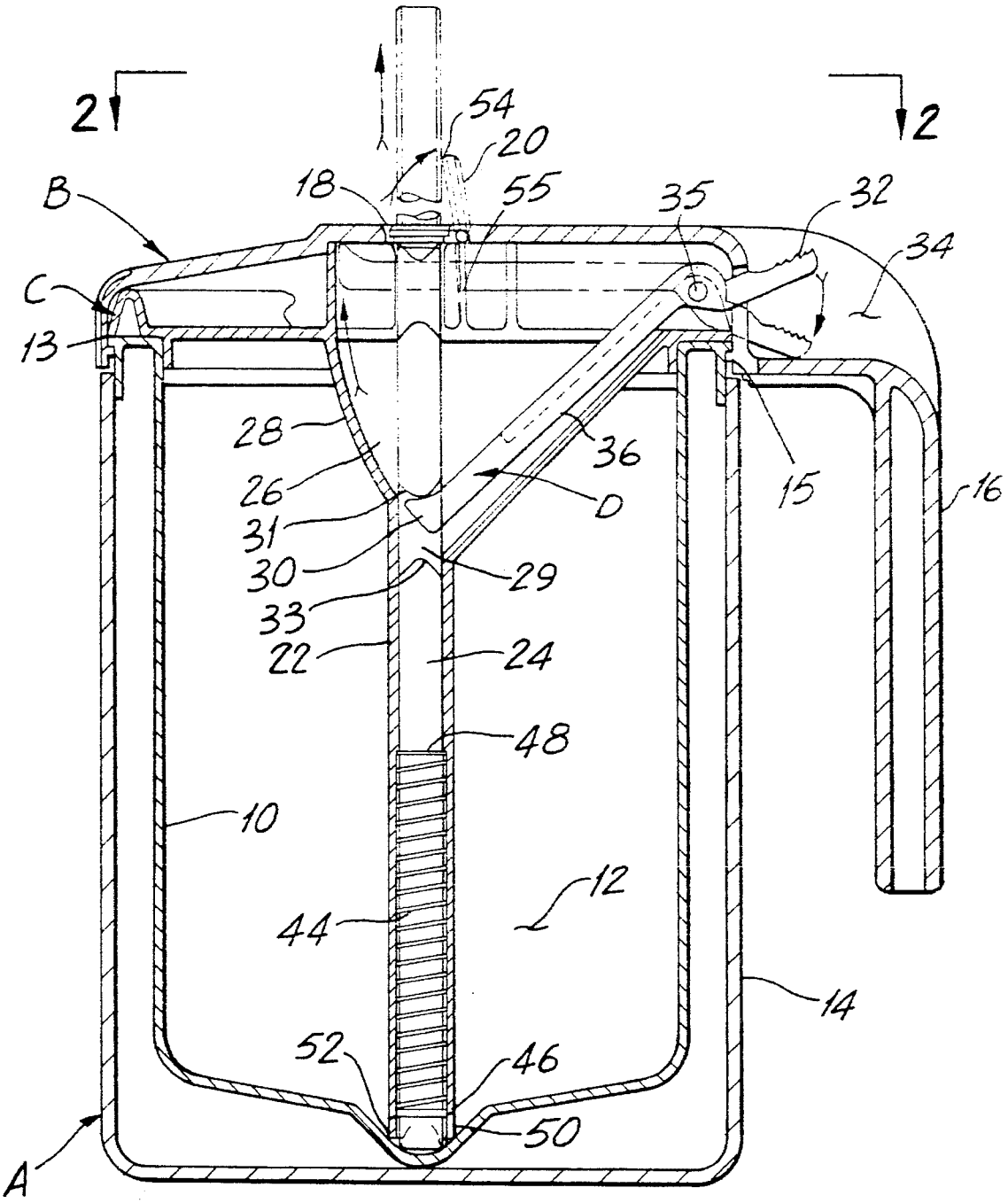
FIG. 1 is a side cross-sectional view of the container of the present invention.

As seen in the drawings, the container includes an insulated cup shaped base, generally designated A, preferably formed of plastic, with air filled hollow walls including an interior wall 10 defining a liquid reservoir 12 and an exterior wall 14. An insulated plastic cover, generally designated B, is adapted to sealingly engage the rim 13 of the open top of base A. Cover B and the rim 13 of base A are provided with interengaging screw threads 15 to permit the cover to be removed from the base, such that the base can be filled or cleaned.

Cover B includes a handle 16 and a central opening 18 which is normally sealed by a spring loaded lid 20, pivotally mounted to the cover.

Extending downwardly from the interior of cover B, into reservoir 12, is a straw containing compartment, generally designated C. Compartment C has a generally tubular hollow section 22 into which retractable plastic sanitary straw 24 is received. Compartment C also includes an enlarged section 26 within which is situated the mechanical linkage, generally designated D, which controls the position of straw 24 as it moves between the retracted position and the protruding position.

Linkage D consists of a simple lever which is pivotally mounted on cover B by means of pins 35. The lever includes an externally accessible portion 32 which is situated within a recess 34 near the top of handle 16, in alignment with the thumb of the user when the handle is gripped. The interior portion 36 of the lever is situated within enlarged section 26. Straw engaging end 30 of lever portion 36 moves in an arcuate path when portion 32 of the lever is depressed. Section 26 of compartment C is provided with an arcuate wall 28 to accommodate such movement.

Figure 2:
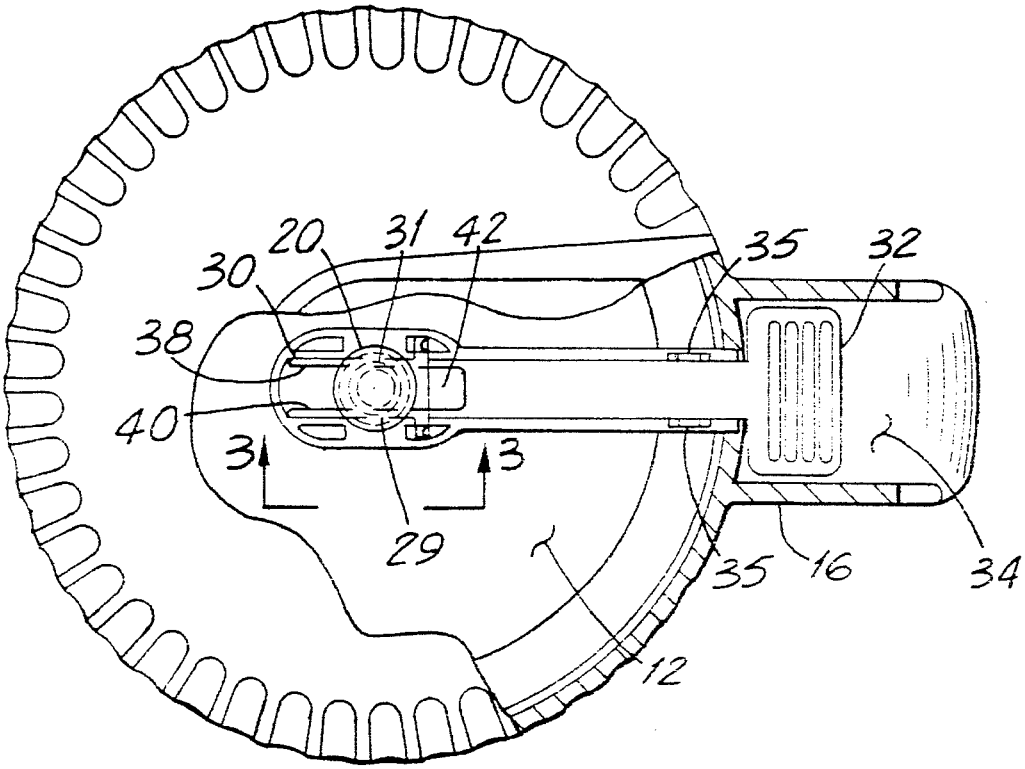
FIG. 2 is a top elevational view of the container.
Figure 3:
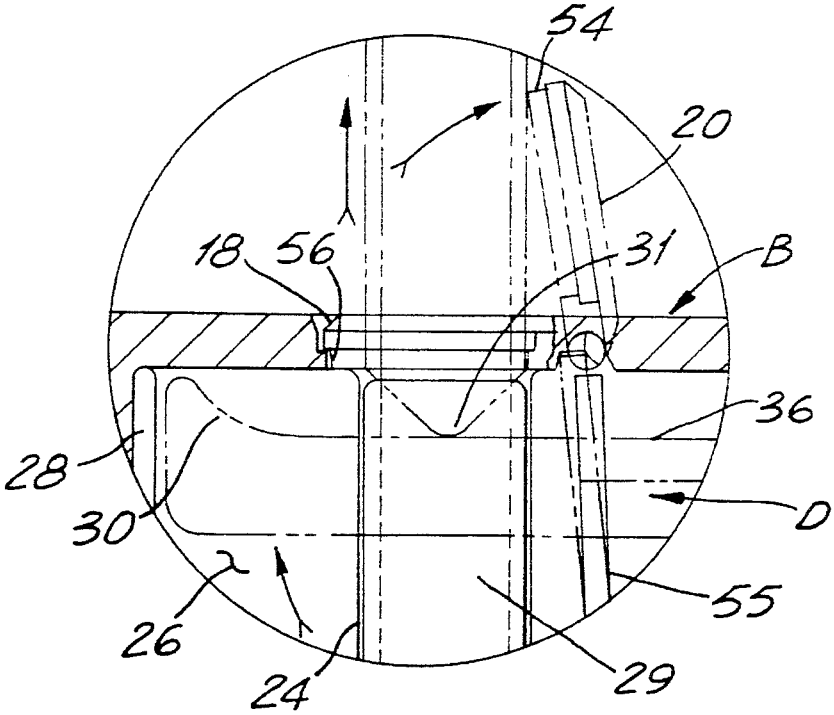
FIG. 3 is an enlarged cross-section view of a section of the container.

The end 30 of the lever portion 36, as best seen in FIG. 2, is bifurcated into legs 38, 40. A portion 29 of straw 24 is reduced in width creating a recess defined by a pair of spaced, oppositely oriented "v" shaped shoulders 31, 33 on each side. Legs 38, 40 are spaced so as to form an elongated slot 42 which is slightly wider than the reduced width of the recessed portion 29 of the straw. The recessed portion 29 of straw 24 is received in slot 42. Legs 38, 40 cooperate with the recesses defined by shoulders 31, 33 on either side of the exterior of the straw to provide a cam slide action. This permits the straw to move vertically relative to cover B and laterally relative to the lever, as the lever moves along its arcuate path.

As lever portion 36 pivots in a clockwise direction (as seen in FIG. 1), straw 24 is moved from the retracted position to the protruding position. As the straw moves upwardly, a coil spring 44 is compressed. Coil spring 44 is mounted between a lip 46 on the exterior of the straw and a lip 48 on the interior of tubular section 22.

The distance between shoulders 31, 33 on each side of straw 24 is perferrably longer than the height of the ends of legs 38, 40. This permits the user to grab the straw when it is in the extended position and move it further above the cover a short distance beyond the highest point at which the straw could normally be moved by lever 36. This may enhance the comfort of certain users, for example, those with a beard.

Liquid passages 50 are formed in tubular portion 22 proximate a recess 52 in wall 10 at the bottom of reservoir 12. The straw is spring loaded towards the retracted position by spring 44. When in the retracted position, the bottom of the straw closes passages 50 by sealing against recess 52 so as not to permit liquid from reservoir 12 into compartment C. Passages 50 allow liquid flow as straw 24 moves towards the protruding position.

As straw 24 is moved toward the protruding position, it pivots lid 20 relative to cover B from a closed position to an open position. Lid 20 is spring loaded toward the closed position by a pair of plastic fingers 55 which deflect like a flat spring as the lid 20 is moved. Lid 20 has a sealing surface 54 which cooperates with a correspondingly shaped lip 56 on the rim of the opening 18 so as to provide a liquid tight seal and to maintain the insulative properties of cover B.

It will now be appreciated that the present invention relates to a liquid container with a retractable straw which operates by means of a simple mechanical linkage in the form of a pivotally mounted lever. Movement of the straw resulting from depressing of the lever causes the liquid passage to the straw containing compartment to open and pivots the lid which normally closes the straw compartment to an open position. Spring loading causes the straw to retract and the lid to close when the lever is released. When the straw is retracted and the lid closed, the container may be tipped over or turned to any position without spilling the liquid.

While only a single preferred embodiment of the present invention has been disclosed for purposes of illustration, it is obvious that many variations and modifications could be made thereto. It is intended to cover all these variations and modifications which fall within the scope of the present invention as defined by the following claims:

We claim:

1. A liquid container comprising an insulated base defining a liquid reservoir having a sidewall and an axis extending in a direction substantially parallel to said sidewall with an open top defined by a rim, a unitary straw, a cover for closing said open top comprising means for sealingly engaging said rim and a straw containing compartment into which said straw is received for linear movement substantially along said axis between a retracted position wherein said straw is entirely within said base below said cover and a protruding position wherein a portion of said straw is situated above said cover, a lever pivotally mounted on said cover having a portion accessible from the exterior of said cover and a portion situated within said compartment and operably engaging said straw, said lever being pivotable to move said straw, as a unit, between said retracted and said protruding positions.

2. The container of claim 1 wherein said compartment comprises a liquid passage connection with said reservoir and further comprising means for closing said passage when said straw is in said retracted position.

3. The container of claim 1 wherein said straw engaging portion of said lever means moves through an arcuate path as said lever is pivoted.

4. The container of claim 3 wherein said compartment comprises an enlarged section shaped to enclose said arcuate path.

5. The container of claim 1 wherein said straw engaging portion of said lever comprises an elongated slot into which the straw is movably received.

6. The container of claim 1 wherein said straw engaging portion is bifurcated.

7. The container of claim 1 wherein said cover further comprises a lid movably mounted on said cover over said straw containing compartment, said lid being movable between a closed position and an open position and means for urging said lid towards said closed position.

8. The container of claim 7 wherein said urging means comprises a spring loaded finger.

9. The container of claim 7 wherein said straw containing compartment comprises means for cooperating with said lid to provide a liquid tight seal.

10. A liquid container comprising an insulated base defining a liquid reservoir with an open top defined by a rim, a straw, a cover comprising means for sealingly engaging said rim and a straw containing compartment into which said straw is received for movement between a retracted position wherein said straw is within said base and a protruding position wherein a portion of said straw is situated above said cover, a lever pivotally mounted on said cover having a portion accessible from the exterior of said cover and a portion situated within said compartment operably engaging said straw, said lever being pivotable to move said straw between said retracted and said protruding positions, said compartment comprising a liquid passage connection with said reservoir and means for closing said passage when said straw is in said retracted position.

11. The container of claim 10 wherein said straw engaging portion of said lever moves through an arcuate path as said lever is pivoted.

12. The container of claim 11 wherein said compartment comprises an enlarged section shaped to enclose said arcuate path.

13. The container of claim 10 wherein said straw engaging portion of said lever comprises an elongated slot into which the straw is movably received.

14. The container of claim 10 wherein said straw engaging portion is bifurcated.

15. The container of claim 10 wherein said cover further comprises a lid movably mounted on said cover over said straw containing compartment, said lid being movable between a closed position and an open position and means for urging said lid toward said closed position.

16. The container of claim 15 wherein said urging means comprises a spring loaded finger.

17. The container of claim 15 wherein said straw containing compartment comprises means for cooperating with said lid to provide a liquid tight seal.

18. A liquid container comprising an insulated base defining a liquid reservoir with an open top defined by a rim, a straw, a cover for closing said open top comprising means for sealing engaging said rim, a straw containing compartment into which said straw is received for movement between a retracted position wherein said straw is within said base and a protruding position wherein a portion of said straw is situated above said cover, a lever pivotally mounted on said cover having a portion accessible from the exterior of said cover and a portion situated within said compartment operably engaging said straw, said lever being pivotable to move said straw between said retracted and said protruding positions, a lid moveably mounted on said cover over said straw containing compartment, said lid being movable between a closed position and an open position and means for urging said lid towards said closed position.

19. The container of claim 18 wherein said urging means comprises a spring loaded finger.

20. The container of claim 18 wherein said straw containing compartment comprises means for cooperating with said lid to provide a liquid tight seal.

* * * * *